United States Patent [19]

Trygg

[11] Patent Number: 4,792,068

[45] Date of Patent: Dec. 20, 1988

[54] NOZZLE WITH AT LEAST ONE OPENING THAT CAN BE CLOSED OFF

[75] Inventor: Lars Trygg, Grangärde, Sweden

[73] Assignee: PKL Verpackungssysteme GmbH, Dusseldorf, Fed. Rep. of Germany

[21] Appl. No.: 108,519

[22] Filed: Oct. 15, 1987

[30] Foreign Application Priority Data

Oct. 29, 1986 [SE] Sweden ..... 8604611

[51] Int. Cl.[4] ..... B67D 3/00; F16K 25/00

[52] U.S. Cl. ..... 222/512; 222/380; 222/504; 251/186; 141/255; 426/392

[58] Field of Search ..... 141/146–147, 141/255, 177; 251/186, 176; 426/392, 397; 222/252, 255, 265, 270, 275–277, 330, 333, 380, 406–407, 504, 512

[56] References Cited

U.S. PATENT DOCUMENTS

| | | | |
|---|---|---|---|
| 2,466,731 | 4/1949 | Nordquist | 141/177 |
| 2,761,607 | 9/1956 | Ayars | 141/177 X |
| 3,395,889 | 8/1968 | Chovan | 251/176 X |
| 3,425,662 | 2/1969 | Bryant et al. | 251/176 |
| 3,538,952 | 11/1970 | Bayer | 251/186 X |
| 3,764,042 | 10/1973 | Shapland et al. | 222/512 X |
| 3,865,281 | 2/1975 | Byrd et al. | 222/252 |

*Primary Examiner*—Michael S. Huppert

*Attorney, Agent, or Firm*—Sprung Horn Kramer & Woods

[57] ABSTRACT

A nozzle with at least one opening that can be closed off, and especially a nozzle for packaging machines, including those that handle liquid products, with a valve body in the form of a piston that moves back and forth between a retracted position wherein it leaves the opening free and an advanced position wherein it completely closes off the opening. The object is to provide a nozzle with highly effective product-trimming action and continued piston operation even during the sterilization process. A guide for the piston has at least two positioning surfaces that operate in conjunction with two essentially opposite surfaces on the piston and precisely position it in the nozzle opening. The piston is axially divided or slit. Tensioning components force the halves of the piston apart and tight against the walls of the nozzle opening.

10 Claims, 1 Drawing Sheet

Fig. 1
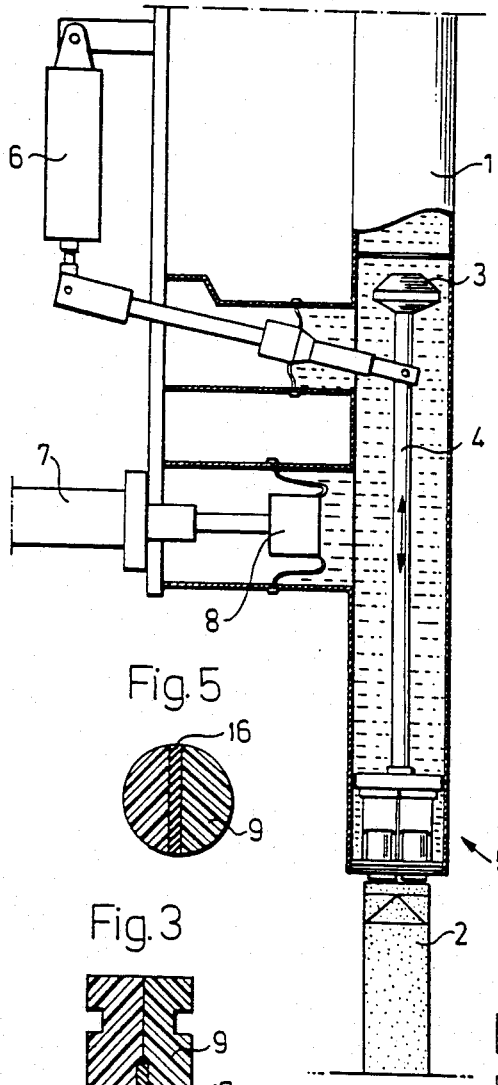
Fig. 2
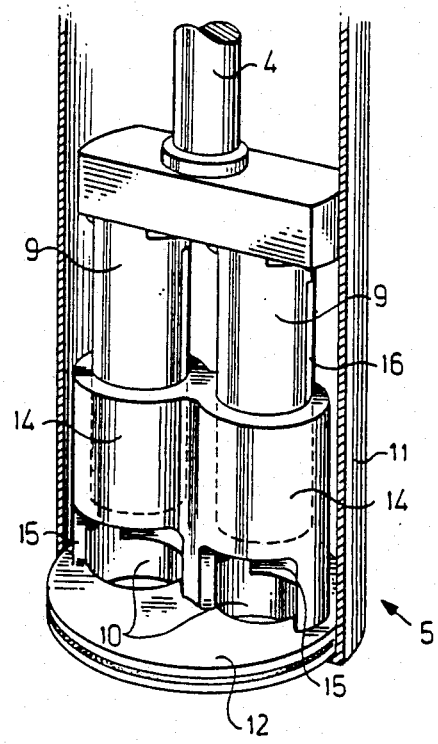
Fig. 5
Fig. 3
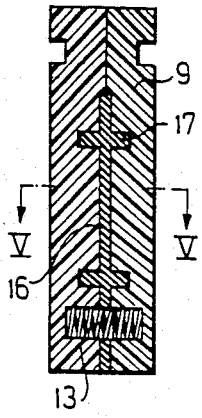
Fig. 4
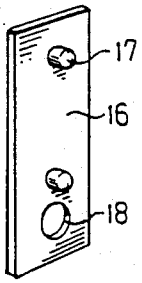
Fig. 6
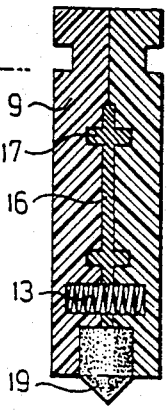
Fig. 7
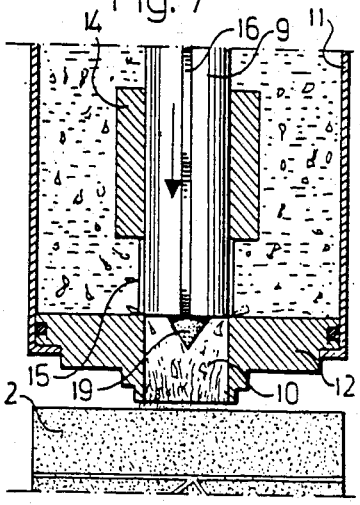

NOZZLE WITH AT LEAST ONE OPENING THAT CAN BE CLOSED OFF

BACKGROUND OF THE INVENTION

The present invention relates to a nozzle 5 with at least one opening that can be closed off, and especially to a nozzle for packaging machines, including those that handle liquid products, with a valve body 9 in the form of a piston that moves back and forth between a retracted position wherein it leaves the opening free and an advanced position wherein it completely closes off the opening.

Nozzles of this type are employed in machines for packaging soups, dairy products, stewed fruits, sauces, etc., which may contain pieces of fruit, vegetables, or meat, in containers that are conveyed in rapid sequence along a conveyor that travels below the nozzle opening. Since these products are food, it is extremely important to maintain sanitary conditions, and the nozzles must be regularly sterilized. Furthermore, the environment around the nozzle is fairly aggressive due to acids from the fruit etc. The components of known nozzles are accordingly made out of stainless steel.

Since the products being packaged often come in fairly large pieces and have long fibers that must be trimmed off during the packaging process, the seat between the piston-like valve body and the nozzle opening must be very tight if the pieces are to be trimmed effectively. The piston, due to the tight seat and the expansion that occurs subject to the high temperatures employed during the sterilization process, gets jammed in the opening or in any piston guides 14 that may be present and cannot operate until the temperature drops back to the normal operating range.

This drawback is acceptable as long as the sterilization is carried out when the machine is down for other reasons. Recently, however, machines have been developed that make it desirable to keep the piston operating even during the sterilization process, which is impossible with known designs and materials if the trimming function of the seat is to be maintained.

SUMMARY OF THE INVENTION

The major object of the present invention is to provide a nozzle of the aforesaid type that will lack the aforesaid drawback and that will feature the advantages of highly effective trimming and continued piston operation even during the sterilization process.

This object is attained in accordance with the invention generally in that the dimensions of the piston automatically adjust to the instantaneous dimensions of the nozzle opening and piston guides and specifically by a guide (14) for the piston (9) that has at least two positioning surfaces that operate in conjunction with two essentially opposite surfaces on the piston and precisely position it in the nozzle opening (10), in that the piston is axially divided or slit, and by tensioning components (13) that force the halves of the piston apart and tight against the walls of the nozzle opening.

Precise positioning ensures that the piston can be precisely introduced into the nozzle opening essentially without play in such a way that it can effectively trim any excess off the product being packaged, with the tensioning components ensuring that the dimensions of the piston will match those of the opening and guide essentially independent of temperature and wear.

It is practical for the piston to be divided or slit along one axial plane that extends between the aforesaid mutually opposing surfaces on the piston that operate in conjunction with the aforesaid positioning surfaces.

The positioning surfaces can preferably be shaped to match the walls of the nozzle opening and merge smoothly into them.

The guide in one preferred embodiment consists of a positioning sleeve (14) that surrounds the piston and is aligned with the opening in the nozzle, and the walls of the sleeve have openings (15) that the piston closes off when it is in the advanced position.

This embodiment has a seal (16) that prevents the product from leaking through the separation or slit in the piston an out of the nozzle opening (10) when the piston is in the advanced position.

The seal can in a practical way be a rubber seal (16) directly adjacent to the shape of the outer demarcating surface of the piston at least in the vicinity of the piston that is located outside the guide (14).

The seal can be a rubber disk (16) with elevations (17) that establish its position, and the halves of the piston can have matching recesses that operate in conjunction with the elevations.

To prevent drops of liquid from remaining on the face of the piston, the rubber disk (16) can have a thicker section at the outer end of the piston that terminates in one or more points (19) that project out of the face of the piston.

When the piston is slit at the front, the seal can be a rubber ring that surrounds the rear and unslit section of the piston and carries out a sealing action in conjunction with a sleeve-shaped piston guide (14) when the piston is in the advanced position.

The components that apply tension to the piston can comprise a resilient component (13) between the halves of the piston.

Some preferred embodiments of the invention will now be specified with reference to the attached drawings, wherein

BRIEF DESCRIPTION OF THE DRAWINGS

FIG. 1 is a schematic and partly sectional drawing of a packaging machine with a nozzle in accordance with the invention, FIG. 2 shows a detail of the packaging machine illustrated in FIG. 1, FIG. 3 is a section through the piston, FIG. 4 illustrates a seal of the type employed with the piston illustrated in FIG. 3, FIG. 5 is a section along the line V—V through the piston illustrated in FIG. 3, FIG. 6 is a section through another embodiment of a piston, and FIG. 7 illustrates a nozzle in accordance with the invention and a piston like that illustrated in FIG. 6 in the course of an operating stroke.

DETAILED DESCRIPTION OF THE PREFERRED EMBODIMENTS

FIG. 1 is a highly schematic drawing illustrating the principle of a packaging machine that employs a nozzle in accordance with the invention. A reservoir 1 stores the product that is to be packaged in containers 2. The containers are conveyed in rapid sequence along a conveyor that travels below the machine. The product can for example consist of stewed fruit or of soup that contains pieces of meat. A valve 3 is attached in the illustrated embodiment to a piston by an activating rod 4. The piston is accommodated in a nozzle 5 in accordance with the invention. Activating rod 4 can be raised and lowered by an activating cylinder 6. Another cylinder 7 acts on a flow-control piston 8.

How the packaging machine works will now be described. When the piston rod drops, it closes off outlet openings in nozzle 5, upon which valve 3 opens and flow-control piston 8 begins to move to the left in the figure, withdrawing a particular portion of the product from reservoir 1. Rod 4 now moves up and valve 3 closes off the outlet of reservoir 1 and releases the outlet openings in nozzle 5, upon which flow-control piston 8 begins to move toward the right, introducing a particular portion of the product into whatever container 2 happens to be under the nozzle.

These operations must occur in rapid sequence and in precise synchronization with the rate at which containers 2 advance, in such a way that all the containers will be filled with precisely the right portion and without spillage, which would contaminate the outside and prevent a subsequent hermetic seal. In particular, no incompletely trimmed pieces or drops of product that could fall onto the containers can remain hanging from the nozzle.

A very tight seat is accordingly necessary between the piston-shaped valve bodies 9 (cf. FIG. 2) and the associated openings 10 in the base plate 12 of cylindrical nozzle housing 11.

To ensure such a tight seat independent of the wear on pistons 9 and on the walls of openings 10 and to avoid problems due to thermal expansion, the piston 9 in accordance with the instant invention can be divided into two halves (cf. FIG. 3) that are subjected to tension generated in the present embodiment by a spring 13 that forces them apart and against the walls of openings 10. The dimensions of a piston of this type will adapt themselves to those of openings 10.

To allow a piston of this type to enter openings 10 precisely and rapidly, however, it must be very precisely guided. This is ensured in accordance with the invention by means of cylindrical guides 14 which have precisely the same inside dimensions as openings 10 and are in precise alignment with them. Pistons 9 will accordingly fit tight against the inside walls of guides 14 and, to allow the product to be forced out of openings 10, the bottoms of the cylindrical guides also have openings 15. These openings are closed off by pistons 9 when the pistons extend into the openings 10 in base plate 12.

Thus, immediately above openings 10, guides 14 constitute two curved positioning surfaces that operate in conjunction with opposing surfaces on the corresponding piston 9. The positioning surfaces merge smoothly into openings 10, preventing the pistons from getting off center in relation to the openings. To ensure tightness it is practical for each piston 9 to be divided along an axial plane that extends between the aforesaid opposing surfaces that merge smoothly into openings 10.

To prevent the product from leaking out through the openings in the nozzle due to the slits in the pistons, it is only necessary to position a seal between the halves of the piston and along the section that extends above guides 14. FIG. 4 illustrates one practical type of seal in the form of a rubber disk 16 that is positioned between the halves of the piston and is wide enough to precisely align with its outer surface (cf. FIG. 5). Disk 16 is secured in position by elevations 17 that fit into matching recesses in each half of the piston. The disk also has an opening 18 to accommodate spring 13.

One alternative to a solid disk is a rubber strip in the form of a frame for example that fits into grooves in the halves of the piston and extends along their edges. A disk or strip of this type will perform the additional essential function of a cushion. Thus, when a piston 9 rapidly enters an associated opening 10 while simultaneously trimming off an excess section of the product, a radially inward force will be generated that will compress the two halves together to a certain extent against the force of spring 13. It can be impractical for the spring to be large enough to resist such an impact-dictated inward motion on the part of the piston halves. The rubber disk or strip, however, will act as an effective impact buffer, decelerating the motion of the components and preventing them from being forced together too extensively. It is also possible if necessary to completely replace the spring with a rubber seal or to construct it out of or provide it with individual pads of elastic rubber etc., attaining the same effect as with a spring. The rubber can exhibit various spring characteristics when subjected to impacts or slow-acting forces.

Piston 9 does not need to be completely divided, but can be provided with a slit that extends over only part of it, assuming only that the halves that are separated by the slit can move to some extent in relation to each other. It is possible, when a piston of this type is employed, to utilize an O ring or similar structure if desired instead of a sell between the two halves of the piston. Such an O ring will extend along a groove around the integral section of the piston, establishing a seal at the lower dead center of the piston in conjunction with the associated guide 14.

It is very important for the product forced out by piston 9 to leave the face of the piston while it is in the advanced position, leaving no drops behind. Due to the rapid motion of the piston during rotation, this is usually no problem. Certain highly viscous or adhesive products can, however, cause problems in this respect. To eliminate these, piston 9 can, as illustrated in FIG. 6, be provided with a point 19 that extends out of its face. This point can for example be the end of a cylindrical rubber component inserted into a matching recess in the piston. The rubber component and point can be integrated into sealing disk 16.

FIG. 7 illustrates a nozzle in accordance with the invention with a piston 9 like that illustrated in FIG. 6 while the intended amount of product is being packaged in a container 2 positioned below the opening in the nozzle. Piston 9 is illustrated at the moment of entering openings 10, at which time the sections of product that are intended to travel past the edge of the opening are being effectively trimmed off between the piston and the edge of the opening.

The embodiments of the piston and guide previously described herein always result in a precise seat between the piston and the edge of openings 10, attaining an effective trimming action and essentially independent of temperature and wear. Thus, sterilization entails no problems for the device in accordance with the invention.

Long-lasting materials of a hardness that will ensure satisfactory trimming can, since the coefficient of heat expansion is no longer critical, be employed in accordance with the invention. It is also possible to employ cheaper materials than previously. One prototype embodiment of the invention employs pistons made out of Torlon and Polysulfon with good results, including trimming effectiveness.

A nozzle of the type specified herein can be manufactured with a wide range of pistons and openings 10, with various types employed together. The tensioning component can be of different types and, when the piston is slit, the resilient flanks of the piston can for example carry out the tensioning function by themselves. Furthermore, instead of one point, the piston can have more than one point of the same size or of different sizes, depending on the nature of the product being packaged, or its surface can be made irregular in some other way to facilitate release of the product. Divided pistons with guides in accordance with the invention can be used for other purposes than packaging and in other systems in ways that will be obvious to one of skill in the art.

It is understood that the specification and examples are illustrative but not limitative of the present invention and that other embodiments within the spirit and scope of the invention will suggest themselves to those skilled in the art.

What is claimed is:

1. In a nozzle with at least one opening that can be closed off, and especially a nozzle for packaging machines, including those that handle liquid products, the nozzle including a valve body in the form of a piston that moves back and forth between a retracted position wherein it leaves the opening free and an advanced position wherein it completely closes off the opening, the improvement wherein the piston is axially divided or slit, the nozzle further including a guide (14) for the piston (9) that has at least two positioning surfaces that operate in conjunction with two essentially opposite surfaces on the piston and precisely position it in the nozzle opening (10), and a tensioning component (13) that forces the halves of the piston apart and tight against the walls of the nozzle opening.

2. A nozzle according to claim 1, wherein the piston is divided or slit along an axial plane that extends between the mutually opposing surfaces on the piston that operate in conjunction with the positioning surfaces on the guide.

3. A nozzle according to claim 1, wherein the positioning surfaces are shaped to match the walls of the nozzle opening and merge smoothly into them.

4. A nozzle according to claim 1, wherein the guide consists of a positioning sleeve (14) that surrounds the piston and is aligned with the opening in the nozzle, the walls of the sleeve having openings (15) that the piston closes off when it is in the advanced position.

5. A nozzle according to claim ,, including a seal (16) that prevents the product from leaking through the separation or slit in the piston and out of the nozzle opening (10) when the piston is in the advanced position.

6. A nozzle according to claim 5, wherein the seal is a rubber seal (16) directly adjacent and conforming to the shape of the outer surface of the piston at least in the vicinity of that piston portion located outside the guide (14).

7. A nozzle according to claim 5, wherein the seal is a rubber disk (16) with elevations (17) that establish its position, the halves of the piston having matching recesses that operate in conjunction with the elevations.

8. A nozzle according to claim 7, wherein the rubber disk (16) has a thicker section at the outer end of the piston that terminates in at least one point (19) that projects from the face of the piston.

9. A nozzle according to claim 5, wherein the piston is slit at its front, the seal comprising a rubber ring that surrounds the rear and unslit section of the piston add carries out a sealing action in conjunction with a sleeve-shaped piston guide (14) when the piston is in the advanced position.

10. A nozzle according to claim 1, wherein the component that applies tension to the piston comprises a spring (13) between the halves of the piston.

* * * * *

UNITED STATES PATENT AND TRADEMARK OFFICE

CERTIFICATE OF CORRECTION

PATENT NO. : 4,792,068

DATED : Dec. 20, 1988

INVENTOR(S) : Trygg

It is certified that error appears in the above-identified patent and that said Letters Patent is hereby corrected as shown below:

| | |
|---|---|
| Col. 2, line 15 | Delete "an" and substitute --and-- |
| Col. 6, line 12 | Delete "," in first instance and substitute --1-- |

Signed and Sealed this

Second Day of January, 1990

*Attest:*

JEFFREY M. SAMUELS

*Attesting Officer*

*Acting Commissioner of Patents and Trademarks*